US005659856A

United States Patent [19]

Day

[11] Patent Number: 5,659,856

[45] Date of Patent: Aug. 19, 1997

[54] VARIABLE PRESSURE BACK-PLATE FOR LIQUID TONING

[75] Inventor: Gene F. Day, Hillsborough, Calif.

[73] Assignee: Phoenix Precision Graphics, Inc., Sunnyvale, Calif.

[21] Appl. No.: 405,350

[22] Filed: Mar. 16, 1995

[51] Int. Cl.[6] ..... G03G 15/10

[52] U.S. Cl. ..... 399/237; 396/604

[58] Field of Search ..... 354/317; 355/356; 399/237, 241; 396/604, 609

[56] References Cited

U.S. PATENT DOCUMENTS

| | | | |
|---|---|---|---|
| 3,027,821 | 4/1962 | Wright | 354/317 |
| 3,417,686 | 12/1968 | Hildebrand et al. | 354/317 |
| 3,685,412 | 8/1972 | Lehmann | 354/317 |
| 3,912,833 | 10/1975 | Becker | 354/317 X |
| 4,289,092 | 9/1981 | McChesney et al. | 354/317 |
| 5,231,455 | 7/1993 | Day | 355/256 |
| 5,268,721 | 12/1993 | Day | 355/256 |
| 5,296,899 | 3/1994 | Day | 355/256 |

*Primary Examiner*—Fred L. Braun
*Attorney, Agent, or Firm*—Thomas Schneck

[57] ABSTRACT

An electrostatic recorder or copier that includes a vise which provides a variable clamping force to a recording medium, thereby capable of squeezing it between an applicator and a backplate. The vise is an expandable bladder expanding and retracting in response to fluid pressure. In this manner, movement of the recording medium may be prevented while purging toner from the applicator. A cross member is provided that is spaced apart from the applicator and the bladder is attached to it. The bladder includes a metal surface, which faces the applicator, capable of conforming to the profile, or irregularities, of the toning surface. The metal surface may be connected as an electrically grounded electrode and may include a single sheet of thin metal or a plurality of segmented metal sheets or plates.

20 Claims, 2 Drawing Sheets

VARIABLE PRESSURE BACK-PLATE FOR LIQUID TONING

TECHNICAL FIELD

The present invention pertains to the field of color printing. Specifically, the present invention pertains to an electrostatic color printer or copier.

BACKGROUND ART

Electrostatic printers and copiers commonly use an electrostatic writing head to form a latent image of electrical charges onto a recording medium such as a flexible paper web. The paper web carrying the latent image is then directed to a liquid toning applicator which deposits oppositely charged toner particles onto the paper web, thereby developing the latent image.

Generally, there are two designs for liquid toning applicators: vacuum-type or pressure-type. The vacuum-type applicators employ a liquid pump to draw toner from a reservoir into and through one or more channels located in the face of the applicator to come into contact with the flexible paper web. The web's flexibility serves to seal the face of the applicator thus permitting the pump to create a vacuum in the channels. The vacuum draws toner into and through the channels. The outlet of the toner pump returns the spent toner to the reservoir. In this manner, a continuous recirculation of the toner occurs.

Despite the inherent advantage of leak protection, suction-type applicators have limited application. These applicators are plagued by slow toning speeds that result from the paper web coming into contact with the toner only in small channels. The channels must be very small to prevent the paper web from being pulled down into them. As the speed of the web passing over the applicator is increased, additional channels are required which leads to increased sliding friction, a phenomena sought to be avoided. Moreover, narrow channels require a greater vacuum to maintain toner flow. They also increase sliding friction by adding to the downward force on the paper web. In addition, this design is unsuitable for creating pictorial images.

The speed and image quality limitations of vacuum-type applicators brought about the first pressure-type toning applicator, in which a wetted roller is rotated against the latent image bearing sheet. A scraper blade removes the excess spent toner from the roller prior to re-wetting with toner and again contacting the image. This method provides uniform toning as well as very low sliding friction. The toner cascading down the scraper blade flows in an unconstrained or uncontained manner and has to be collected with a full width funnel or gutter, similar to collecting rainwater by a roof gutter. This gutter is hard to clean by simple rinsing compared to the small vacuum slits of the previous art.

The small slits of the vacuum system can be scoured by simply passing clean fluid through them at high speed. With the roller system, running clear fluid through the toning system can effect cleaning but it is very slow, in fact, too slow to permit a single applicator to be used for multiple colors. Thus, with prior art toning methods, both vacuum and pressure, it is not possible to achieve high quality and high toning speed in a cleanable toning system. Therefore, it is not possible to achieve the cost advantages of a single applicator design in a high speed, high quality printer. This fact led to the development of another type of pressure toning system, namely the positive air-pressure design. This new design permits high quality and speed in a readily cleanable system.

The positive air-pressure system, described in U.S. Pat. No. 5,268,721 to Day, assigned to the assignee of the present invention, uses pressurized air to confine the toner rather than suction. This permits the toner to be pumped through the channels of an applicator rather than drawn through by suction. The web is not drawn tightly against the face of the applicator and high friction is avoided. Furthermore, the toner flow is totally contained and high speed cleaning is possible in contrast to the open-flow of the roller system. Since there is no suction, the channels facing the web can be arbitrarily large and this permits high speed toning as well.

As disclosed in U.S. Pat. No. 5,268,721 a pressurized air channel completely surrounds the wet area of the applicator. The fact that the air pressure is higher than the fluid pressure assures that toner cannot escape against the higher air pressure. In the prior vacuum system, ambient or room air pressure is higher than the liquid pressure and leakage is prevented. Since the toner is confined in the positive air-pressure applicator, no funnel or gutter is needed and high speed cleaning is possible. A planar backing member behind the paper web, i.e. on the other side of the web, is used to keep the web flat against the applicator face.

U.S. Pat. No. 5,296,899 to Day, also assigned to the assignee of the present invention, discloses a positive air-pressure applicator with a segmented backplate which flexibly retains the paper web in close proximity to the surface of the applicator so that excess air does not leak from between the applicator surface and the paper web. In one embodiment, a backing plate segment is elastically supported by a cross member via a compressed spring. In an alternate embodiment, a leaf spring is riveted to the cross member and supports the backing plate segment. The backing plate is formed from a plurality of segments. Each segment is independently supported by the cross member via a compressed spring. In this manner, the backing plate may conform to the irregularities in the surface of the applicator and, thereby, avoid excess air leakage.

U.S. Pat. No. 5,231,455 to Day discloses a method and apparatus for reducing the effective common volume of an applicator that is shared with a plurality of reservoirs containing toners of different colors. A pump is employed for applying toner to the paper web and washing. An air-blower is employed to purge the applicator of toner.

A problem encountered with the aforementioned inventions is the leakage of toner while purging the toner from the applicator. What is needed is a graphics quality applicator that can be cleaned by passing a dispersant through the unit while avoiding toner leakage.

SUMMARY OF THE INVENTION

This object has been achieved by having an electrostatic recorder or copier that includes a vise means for providing a variable clamping force to a recording medium, thereby capable of squeezing it between an applicator and a backplate. This arrangement is based upon the recognition that toner leakage could be avoided during a purge step by tightly clamping a recording medium, such as a paper web, to the applicator so that paper movement is prevented. The vise means is typically an expandable bladder that expands and retracts in response to air pressure from an air-pressure source. A cross-member is provided that is spaced apart from the applicator. An adhesive attaches the bladder to the cross-member. The bladder includes a metal surface, facing the applicator, capable of conforming to the irregularities of the toning surface. The metal surface may be connected as an electrically grounded electrode. In one embodiment, the metal surface is a thin single sheet of metal that may have a surface area at least as large as the surface area of the toning surface. In an alternate embodiment, the metal surface includes a plurality of metal sheets or plates that may have a combined surface area at least as large as the surface area of the toning surface.

BEST MODE FOR CARRYING OUT THE INVENTION

Figure 1:
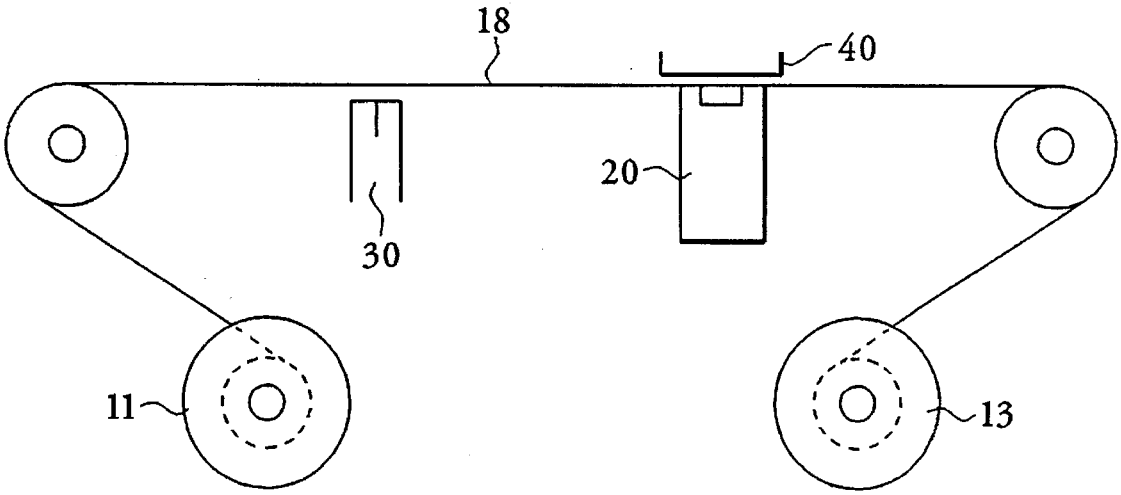
FIG. 1 is a simplified schematic view of an electrostatic printing and copying apparatus utilizing a toner applicator in accord with the present invention.

Referring to FIG. 1, an electrostatic printing and copying system is shown in accord with the present invention. Paper supply roller 11 and take-up roller 13 accurately position a recording medium, such as paper web 18, and maintain tension in the web 18. The toner applicator 20 spans the width of paper 18. Liquid toner is supplied to applicator 20 and flows across the entirety of a slightly recessed upper applicator surface. This forms a shallow channel which allows toner particles to adhere to charged regions of paper web 18. An electrostatic writing head 30 is located elsewhere in close proximity to the web. Head 30 has an array of closely spaced wires connected to a high voltage supply to deposit an electrostatic charge on the paper web, thereby writing a latent image. A backing support 40 resides above toner applicator 20, such that paper web 18 is disposed between the backing support 40 and the applicator 20.

Figure 2:
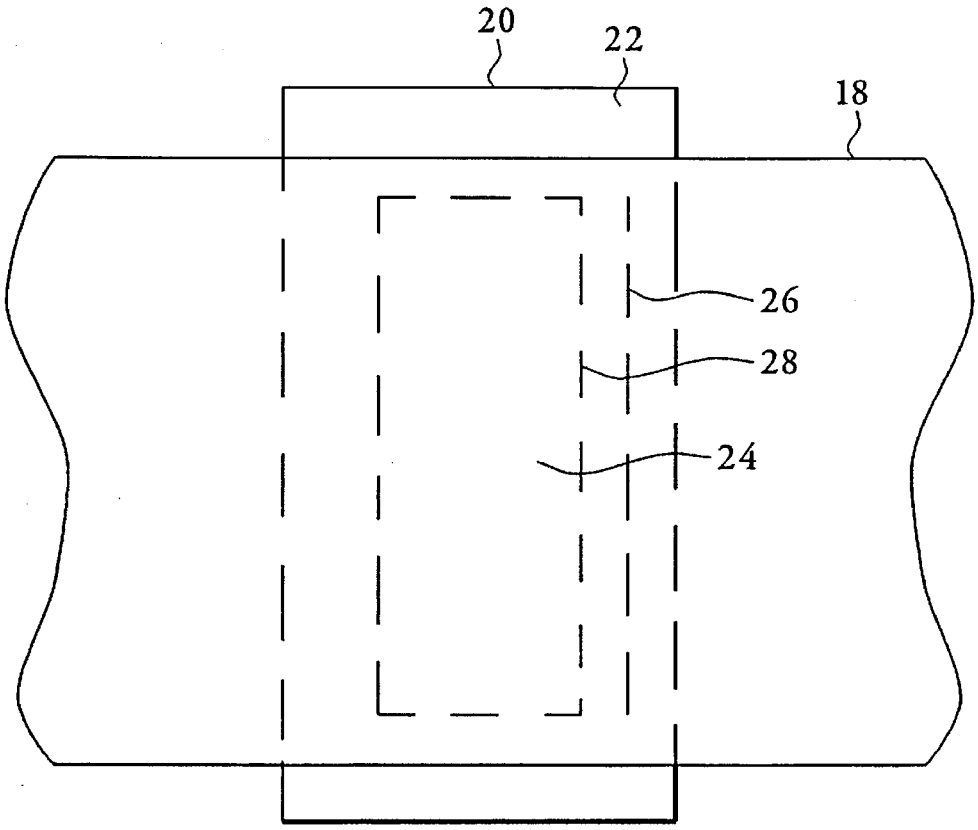
FIG. 2 is a top view of the toning shoe and applicator of FIG. 1 in accord with the present invention.

Referring to FIG. 2, a partial simplified top view of FIG. 1 is shown with the backing support removed. The toner applicator 20 is more clearly illustrated. As can be seen in FIG. 2, toner applicator 20 effectively spans the entire width of paper web 18. Paper web 18 is typically 36 inches in width. Applicator 20, having a working surface defined by area 24 and elevated surrounding surface 22, applies liquid toner across the entire width of web 18 except for small border regions at each edge. Working surface 24 may be as much as 36 inches wide and have a length of ½ to 2 inches. Working surface 24 is recessed below surrounding border areas 22 by 0.002 to 0.010 inch. Paper web 18 is controlled so that it moves across toner applicator 20 such that the entire image surface of web 18 has toner applied thereto via applicator 20. Air knife 26 removes excess toner from web 18 at the downstream edge of applicator 20. Surface 24 of applicator 20 is generally surrounded by a slit 28, into which air is introduced such that the liquid toner is confined to working surface 24. The backing support 40, not shown, resides directly above applicator 20, and is used to retain paper web 18 in close proximity to surface 24 such that air in slit 28 does not leak out excessively from between surrounding surface 22 and paper web 18.

Figure 3:
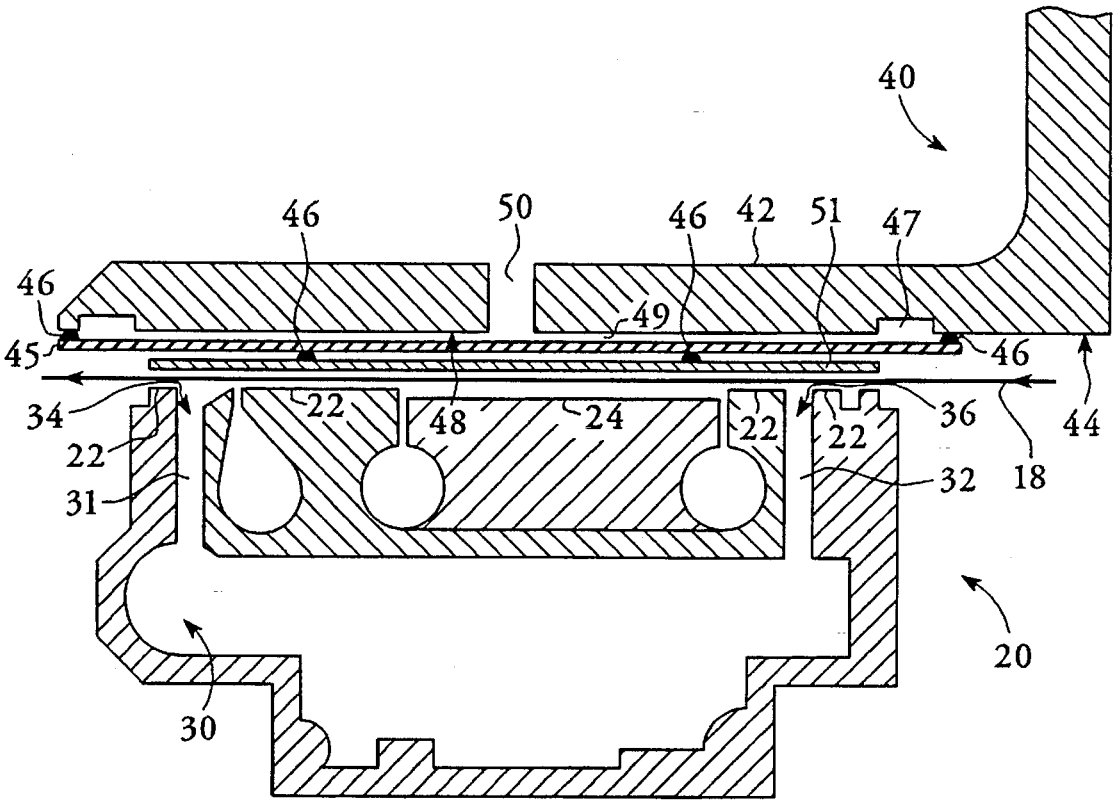
FIG. 3 is a cross-sectional side view of the applicator and backplate in accord with the present invention.

Referring to FIG. 3, a side sectional view of a toner applicator 20 and the backing support 40 of the present invention is shown. Although applicator 20 is shown "free-standing", in practice, applicator 20 will be supported by a structure contained within the housing of a printer or copier. Air from an air supply means, not shown, is supplied to airway 30. Air flows upward through airway slits 31 and 32 until it reaches upper surrounding surface 22 of applicator 20. The air pressure at the topmost ends 34 and 36 of airway slits 31 and 32 is greater than the liquid pressures along working surface 24 lying between topmost ends 34 and 36, so as to fully contain the toner and prevent leakage of the toner beyond the long edges of applicator 20. At the near and far ends of applicator 20, U-shaped passages or grooves, not shown, open at the top, are provided in the upper surface 22 of the ends of applicator 20 in such a manner as to connect topmost ends 34 and 36 with each other at the near and far ends of applicator 20. These two passages together with topmost ends 34 and 36 form the rectangular slit 28 indicated in FIG. 2.

Backing support 40 has a cross member 42 which is spaced-apart from the applicator 20. Typically, the cross member has a planar surface 44 facing the surfaces 22 and 24 of the applicator 20. The surface area of the planar surface 44 is at least as large as the working surface 24 area of the applicator 20. In the preferred embodiment, the planar surface 44 and the applicator surfaces 22 and 24 are rectangular in shape. Attached to the planar surface 44 is an elastic bladder 45. The bladder 45 attaches along its periphery and typically has the same shape as the planar surface 44. Although the bladder 45 may be formed from any elastic material, typically it is made from a flat sheet of 0.015 inch thick neoprene or buna-N rubber. It is preferred to attach the bladder 45 using a cyanoacrylate adhesive 46. The planar surface 44 includes a groove 47 that follows the rectangular periphery of the bladder 45, defining an inner surface 48. The adhesive 46 is applied on the outside of the groove 47 so that an air-tight seal is formed between the bladder 45 and the planar surface 44. The groove 47, typically 1/16 inch deep and ¼ inch wide, has sufficient dimensions to prevent wicking of the adhesive 46 inward into the inner surface 48. The bladder 45, adhesive 46, groove 47 and inner surface 48 define a chamber 49. Extending completely through the cross-member 42 into fluid communication with the chamber 49 is a through-hole 50. Excepting the through-hole 50, chamber 49 is air-tight.

Attached to the side of the bladder 45 opposite from the planar surface 44, is a thin metal sheet 51. Generally, metal sheet 51 is planar with a surface area at least as large as the applicator surfaces 22 and 24. It is preferred that metal sheet 51 is coextensive with the surrounding surface 22 of the applicator. As with attaching the bladder 45 to the planar surface 44, the bladder is attached to sheet metal 51 with an adhesive 46. The adhesive 46 used to attach the sheet metal 51 is distantly positioned from the periphery of the bladder 45.

In operation, a fluid, typically air, is introduced into the chamber 49 via through-hole 50. The fluid-pressure present in the chamber 49 is application dependent. For example, while printing, the fluid-pressure in chamber 49 is sufficient to expand the bladder 45 so that the thin metal sheet 51 resides directly above applicator 20, to retain the paper web 18 in close proximity to surface 24. In this manner, air expelled from rectangular slit 28 does not leak out excessively from between surface 22 and paper web 18. During a purge step, in which toner is expelled from applicator 20, the fluid pressure in the chamber is sufficient to expand the bladder 45 so that it clamps the paper web 18 to the applicator surface 24. In this fashion, the bladder operates as a vise means with a variable clamping force. Preventing movement of the paper web 18 away from applicator surface 22 was necessitated to overcome pulsations resulting from liquid toner or clear dispersant passing through the applicator under air pressure used to purge it. It was recognized that the pulsations probably resulted from the clear dispersant encountering flow impedances, e.g., a corner, tube-fitting, a control valve or the like. The pulsations caused toner leakage around the paper web 18 during a purge step. To overcome this problem, an elastic bladder was employed. During the purge step, the paper web is pressed between the metal sheet 51 and the applicator surface 24, preventing its movement. During the toning step, the pressure between the metal sheet 51 and the applicator 20 can be varied by varying the pressure in the chamber 49. If the pressure in chamber 49 is reduced to zero, the metal sheet 51 may retract slightly from the back of the web. Typically, the support cross member 40 is adjusted at zero pressure so that there is 0.005 to 0.025 inch of net "clearance" between the mating surfaces. Sheets of paper or other shim means may be used during printer set-up for this purpose. Such sheets of paper or other shim means are positioned on top of the applicator surface, then the cross-member-bladder-sheet metal assembly is rested on top of the applicator upper surface 22 and firmly clamped in that vertical position. Upon removal of the paper sheets or other shim means, the desired clearance is produced. At zero pressure the clearance may exist between web 18 and sheet metal 51 or it may exist between bladder 45 and the cross-member bottom surface 44. Which situation occurs depends on the weight of the sheet metal 51 and the stretch of the bladder 45. In the preferred embodiment the bladder is slack so that the weight of the sheet metal rests on the back of web 18. In the preferred embodiment, the fluid used to pressurize chamber 49 is air.

The periphery of the bladder 45 is attached to the planar surface 44 to facilitate expansion of the bladder toward the applicator 20. The groove 47 is provided to control the spread of the adhesive 46 so that the area of the bladder 45 actually bonded to the planar surface 24 is well defined. The adhesive 46 attaching the metal sheet 51 to the bladder 45 is distantly positioned from the periphery so that the metal sheet 51 will move uniformly to hold the paper web against applicator 20. Therefore, adhesive 46 is positioned proximate to the center of the metal sheet 51. In addition, the metal sheet 51 must be sufficiently pliable so that it may conform to irregularities present on the surface 24 of the applicator 20.

Figure 4:
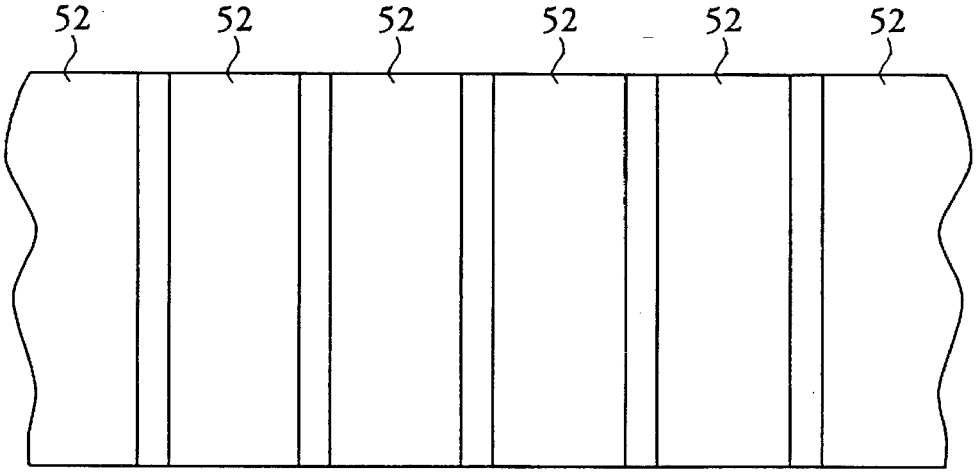
FIG. 4 is a bottom-up view of a plurality of metal sheets or plates attached to an expandable bladder in accord with one embodiment of the present invention.

To facilitate having the metal surface 51 conform to the applicator surface 24, the metal surface may comprise of a plurality of segmented metal sheets, as shown in FIG. 4. Each metal segment 52 is then independently attached to the bladder using an adhesive 46, as discussed above. Each of the metal segments 52 has a flat surface to bear against paper web 18. As with the single sheet of metal, the combined area of the flat surface is at least as large as the area of the upper applicator surface 22. Generally, each metal segment has a width of approximately ½ to 3 inches. Thus, by using multiple backing segments 52, paper web 18 may be held in close proximity to applicator 20 along the entire length of applicator 20. The metal segments 52 are attached closely together along cross member the bladder 45 such that no large gaps or wide spaces are present between them. Although metal segments 52 may be slightly separated from each other, the separation between segments is not large enough to allow paper web 18 to be lifted from the surface of applicator 20. Typically, the gap between adjacent segments is 0.04 inch or less. In so doing, paper web 18 may be held at the desired position along the entire surface of applicator 20 such that no excess air leaks from between applicator 20 and web 18.

The plurality of metal segments conform very well to the irregularities in the upper surface 22 of the applicator 20. In addition, by using several metal segments 52 having small contacting surfaces instead of a single larger thin metal sheet, the backing support 40 of the present invention may be formed using readily available mass-produced parts. Thus, the considerable expense of machining a single piece backing support precisely conforming to variations in the surface of the applicator is eliminated. Although metal segments 52 have a width of ½ to 3 inches in the preferred embodiment, the methods of the present invention are also suitable for backing segments having different dimensions and shapes.

It may be desirable, for instance, to have gaps between segments which are not parallel to the web advance direction. Such parallel gaps can, under some circumstances, lead to image artifacts. To this end the segments could be made in the shape of parallelograms or the like so that any imaging effects of the segment gaps might be avoided. The scope of this invention is intended to include segments of any shape which might be required to make images of arbitrary precision and quality. The segments can also consist of rigid plates rather than thin sheet metal. In one preferred embodiment, the segments consist of lapped aluminum plates which are 0.22 inch thick, 3 inches wide, and 3.5 inches long (in the web advance direction). By making the segments in this way and by reducing the 3-inch width to an arbitrarily smaller value, extremely precise fitting to the applicator upper surface 22 may be effected even if the flatness of that applicator surface is somewhat irregular.

In addition to holding paper web 18 in place, the metal surface may also serve as a grounding electrode. As an electrostatic writing head deposits an electrostatic image onto one side of web 18, it is necessary to continuously remove electrical charge from the opposite side of web 18 in order to prevent a strong negative potential from appearing in the portion of the web undergoing toning. Such a strong negative potential can cause severe fogging or staining of the image. The metal surface attached to bladder 45 may serve as an especially effective grounding electrode and is thus very effective in preventing unwanted fogging and staining of the toned image.

In addition to the above electrical benefit, it is desirable to maintain the web 18 near electrical ground potential for other reasons. Even if no latent image formation is taking place (no writing), the act of toning itself produces electrical currents which can cause the web to acquire a positive electrical potential. Such a positive electrical potential does not normally cause fogging or staining as does a negative potential, but it can strongly inhibit the toning process from completely taking place. The same effective electrical grounding enabled by the metal surface also enhances the toning process itself and renders it more effective. This not only produces enhanced colors but reduces "residual potential" problems which typically cause color impurities in the finished print.

I claim:

1. A backing assembly for an electrostatic recorder or copier comprising:

a toner applicator having a toning surface;

a recording medium having a first major surface bearing a latent image and an opposed second major surface, said applicator facing the first major surface, placing said toning surface in fluid communication with said recording medium;

a cross member spaced apart from said toning surface, said cross member extending across said applicator; and a vise means, connected to said cross member, for selectively squeezing said recording medium between said vise means and said toner applicator in response to fluid pressures expanding said vise means.

2. The backing assembly as recited in claim 1 wherein the vise means includes an elastic bladder.

3. The backing assembly as recited in claim 2 wherein said bladder is formed from an elastic material selected from the group consisting of neoprene or buna-N and includes an electrically grounded electrode facing said toning surface.

4. The backing assembly as recited in claim 1 wherein said vise means includes an elastic bladder and said cross member has an aperture in fluid contact with said bladder for introducing a fluid therethrough to expand said bladder.

5. The backing assembly as recited in claim 1 wherein the vise means includes a metal surface facing the toning surface to conform to the profile of the toning surface.

6. The backing assembly as recited in claim 1 wherein the vise means includes a plurality of metal sheets facing the toning surface to conform to the profile of the toning surface.

7. The backing assembly as recited in claim 1 wherein said fluid pressures are pneumatic.

8. The backing assembly as recited in claim 1 wherein recording medium squeezed between said vise means and said toner applicator creates a medium-applicator-interface, with said vise means being adapted to supply a sufficient magnitude of force to said recording medium to prevent liquid from moving between said medium-applicator-interface.

9. A backing assembly for an electrostatic recorder or copier including a recording medium, said recorder or copier comprising:

a positive pressure toner applicator having a length, spanning the entire width of said recording medium, and a toning surface, with said toning surface in fluid communication with said recording medium to apply toner thereto, said recording medium being disposed across said toning surface;

a rigid cross member having a planar surface spaced apart from said toning surface, said planar surface extending across said applicator; and an elastic bladder, connected to said planar surface, for selectively squeezing said recording medium between said bladder and said toner applicator in response to fluid pressures, expanding said bladder, with said cross member including an aperture in fluid communication with said bladder for introducing fluids therethrough.

10. The backing assembly as recited in claim 9 wherein said bladder has dimensions at least coextensive with said toning surface.

11. The backing assembly as recited in claim 10 wherein said bladder includes a flat elastic material with a periphery, with the flat elastic material being attached, only along said periphery, to the planar surface.

12. The backing assembly as recited in claim 11 wherein the bladder expands in response to pneumatic pressures.

13. The backing assembly as recited in claim 11 wherein said planar surface includes a groove, defining a perimeter of an area, said periphery being attached to said groove by an adhesive, with said groove having dimensions sufficient to prevent wicking of the adhesive.

14. The backing assembly as recited in claim 11 wherein said bladder includes an electrically grounded electrode facing said toning surface to contact said medium.

15. The backing assembly as recited in claim 14 wherein said electrode includes a metal surface having a surface area at least as large as the surface area of said toning surface, to conform to the profile of the toning surface.

16. The backing assembly as recited in claim 14 wherein said electrode includes a plurality of metal sheets having a combined surface area at least as large as the surface area of the toning surface to conform to the profile of the toning surface.

17. The backing assembly as recited in claim 9 wherein recording medium squeezed between said elastic bladder and said toner applicator creates a medium-applicator-interface, with said elastic bladder being adapted to supply a sufficient magnitude of force to said recording medium to prevent liquid from moving between said medium-applicator-interface.

18. A method for purging a toner applicator of an electrostatic printer or copier, comprising the steps of:

providing a positive pressure toner applicator having a toning surface in fluid communication with a recording medium to apply toner to said medium, a cross member spaced apart from said toning surface, and a vise means, connected to said cross member, for providing a variable clamping force to said recording medium, said vise means including an elastic bladder;

applying a clamping force to said recording medium by pneumatically expanding said bladder so as to squeeze said medium between said applicator and said vise means, preventing movement of said recording medium; and passing dispersant through said applicator under high pressure.

19. The method as recited in claim 18 further including the step of releasing said clamping force sufficiently so that said medium can be freely moved across said toning surface to allow toning of a latent image.

20. The method as recited in claim 19 wherein said releasing step includes deflating said bladder to position said recording medium at a predetermined distance from said toner applicator.

* * * * *